US007404305B2

(12) United States Patent
Kim et al.

(10) Patent No.: US 7,404,305 B2
(45) Date of Patent: Jul. 29, 2008

(54) WASHING MACHINE AND DRYER HAVING TILTED DOOR

(75) Inventors: Jong Seok Kim, Changwon-shi (KR); Yang Hwan No, Changwon-shi (KR); Han Ki Cho, Changwon-shi (KR); Yeon Su Jung, Changwon-shi (KR); Jung Hoon Kang, Changwon-shi (KR); Myung Sik Park, Changwon-shi (KR); Young Hoon Ha, Masan-shi (KR)

(73) Assignee: LG Electronics, Inc., Seoul (KR)

( * ) Notice: Subject to any disclaimer, the term of this patent is extended or adjusted under 35 U.S.C. 154(b) by 421 days.

(21) Appl. No.: 10/471,946

(22) PCT Filed: Jan. 17, 2003

(86) PCT No.: PCT/KR03/00108

§ 371 (c)(1),
(2), (4) Date: Sep. 17, 2003

(87) PCT Pub. No.: WO03/060224

PCT Pub. Date: Jul. 24, 2003

(65) Prior Publication Data

US 2004/0103691 A1 Jun. 3, 2004

(30) Foreign Application Priority Data

Jan. 17, 2002 (KR) ..... 10-2002-0002688

(51) Int. Cl.
*D06F 37/28* (2006.01)

(52) U.S. Cl. ..... 68/196; 34/603

(58) Field of Classification Search ..... 68/196; 34/601, 603

See application file for complete search history.

(56) References Cited

U.S. PATENT DOCUMENTS 2,296,265 A * 9/1942 Russell ..... 68/3 R
2,974,801 A * 3/1961 Bernstein ..... 210/144
3,072,386 A * 1/1963 Horecky ..... 366/232
3,276,229 A * 10/1966 Deiss ..... 68/139

(Continued)

FOREIGN PATENT DOCUMENTS

CN 1213024 4/1999

(Continued)

OTHER PUBLICATIONS

European Patent Office 0 343 151 May 1989.*

(Continued)

*Primary Examiner*—Frankie L Stinson
(74) *Attorney, Agent, or Firm*—McKenna Long & Aldridge LLP

(57) ABSTRACT

A washing machine and dryer is disclosed, in which a user can watch the inside thereof, and a user can put the laundry into the inside thereof, and draw out the same. The washing machine includes a cabinet having an opening at the front thereof; a tub provided inside the cabinet for storing washing water; a drum being rotatably provided to a spinning shaft by a motor inside the tub; and a door provided at the opening for being tilted to the inside of the washing machine. The dryer has the same structure as the washing machine.

20 Claims, 5 Drawing Sheets

U.S. PATENT DOCUMENTS

| | | | | | |
|---|---|---|---|---|---|
| 3,584,394 | A | * | 6/1971 | Grabek | 34/599 |
| 4,665,628 | A | * | 5/1987 | Clawson | 34/449 |
| 6,029,300 | A | * | 2/2000 | Kawaguchi et al. | 8/159 |

FOREIGN PATENT DOCUMENTS

| | | | | |
|---|---|---|---|---|
| CN | 2382733 | Y | | 6/2000 |
| CN | 2425106 | Y | | 3/2001 |
| DE | 195 15 040 | | * | 10/1996 |
| EP | 1 116 812 | A1 | | 7/2001 |
| GB | 2164666 | | * | 3/1986 |
| JP | 10328473 | | * | 12/1988 |
| JP | 4-166196 | | * | 6/1992 |
| JP | 9-94391 | | * | 4/1997 |
| JP | 11-156533 | | | 6/1999 |
| JP | 2000-279679 | | * | 10/2000 |
| JP | 2000-342880 | | * | 12/2000 |
| JP | 2001-9188 | | * | 1/2001 |
| JP | 2001009188 | A | | 1/2001 |
| JP | 2001-149685 | | * | 6/2001 |
| JP | 2001-276469 | | * | 10/2001 |
| JP | 2001276481 | A | | 10/2001 |
| WO | WO 00/60157 | | | 10/2000 |

OTHER PUBLICATIONS

WIPO WO 99/54539, Oct. 1999.*

International Search Report; Mar. 31, 2003; Austrian Patent Office; 2 pages.

* cited by examiner

WASHING MACHINE AND DRYER HAVING TILTED DOOR

TECHNICAL FIELD

The present invention relates to a washing machine and a dryer, and more particularly, to door structures of a washing machine and a dryer.

BACKGROUND ART

In general, a washing machine is an appliance for washing laundry by a friction of circulated washing water and laundry with detergent in a water tank. A dryer is an appliance for drying wet laundry with a blow of a hot air heated by a heater. The washing machine and the dryer are respectively classified into various types according to structural features. For convenience, only drum-type washing machine and dryer will be described as follows, in which a spinning shaft of a drum is horizontally provided.

FIG. 1 is a cross sectional view illustrating main parts of a related art drum-type washing machine:

Referring to FIG. 1, the related art drum-type washing machine is provided with a cabinet 2 having an opening 1 at the front thereof, and a tub 4 and a drum 10 provided inside the cabinet 2. The tub 4 stores washing water therein. The drum 10 being rotatably provided to a horizontal spinning shaft 7 in the tub 4 receives the laundry and detergent therein. A suspension 8 is further provided in a space between the tub 4 and the cabinet 2 as a shock absorber during a rotation of the drum 10.

As shown in the drawing, a motor 6 may be provided at the rear of the drum 10 for being directly connected to the horizontal spinning shaft 7. However, the motor 6 may be provided at a lower portion of the cabinet 2, so that a driving shaft of the motor 6 may be connected to the horizontal spinning shaft 7 by a belt. Also, the drum 10 has an opening at the same direction as those of the cabinet 2 and the tub 4, and a spinning shaft 7 of the motor 6 is provided at a rear outer wall. A trivet-shaped spider 9 may be provided at one end of the spinning shaft 7 of the motor 6, and the spider 9 is fixed to the rear outer wall of the drum 10. When driving the motor 6, the drum 10 is rotated in the center of the horizontal spinning shaft 7, thereby washing the laundry. A plurality of lifters 12 are provided on an inner wall, which protrude toward the center of the rotation. That is, the plurality of lifters 12 lifts the laundry when the drum 10 rotates, thereby improving washing efficiency.

Meanwhile, the dryer has a similar structure to the aforementioned washing machine, which is an appliance for drying the wet laundry after washing the laundry. That is, the washing water is not provided to the dryer. The dryer does not require a turbo that is necessary for the washing machine. Generally, a drum 10 of the dryer slowly rotates as compared with that of the washing machine. The dryer further includes a heater (not shown) for drying the wet laundry, and a blower (not shown) for providing a hot air generated from the heater to the inside of the drum 10. The dryer vaporizes moist of the wet laundry with the hot air from the heater, and the vaporized moist is exhausted to the outside of the dryer, thereby drying the laundry.

FIG. 2 is a cross sectional view illustrating a door structure of the related art drum-type washing machine and the dryer. The door 20 is provided at the opening 1 of the cabinet 2 for selectively opening and closing the opening 1, which includes a door frame 22 and a door glass 24. The door frame 22 has a circle-shape at the front, which is rotatably fixed to one portion of the opening 1. The door glass 24 is provided at the center portion of the door frame 22, so that a user can watch the inside of the drum through the door glass 24. The door frame 22 is placed on the opening 1, and the door glass 24 is provided at the center portion of the door frame 22.

However, the door 20 of the related art washing machine and the dryer is disposed low as compared with the user, and the door 20 is perpendicular to a floor. That is, the door 20 is horizontal with the user and the front surface of the cabinet 2, so that the user has to bend over for putting the laundry into the inside of the drum, thereby generating user's inconvenience.

DISCLOSURE OF INVENTION

An object of the present invention is to provide a washing machine and a dryer, in which a user can watch the inside of a drum thereof, and easily put and draw out the laundry, thereby improving user's convenience.

For achieving the foregoing object of the present invention, there is provided a washing machine comprising a cabinet having an opening at the front thereof; a tub provided inside the cabinet for storing washing water; a drum being rotatably provided to a spinning shaft by a motor inside the tub; and a door provided at the opening for being tilted to the inside of the washing machine.

In another aspect of the present invention, a dryer includes a cabinet having an opening at the front thereof; a drum being provided inside the cabinet for being rotatably provided to a spinning shaft by a motor; a heater generating a hot air drying the laundry inside the cabinet; a blowing element blowing the hot air generated from the heater to the inside of the drum; and a door being provided at the opening for being inwardly tilted.

In the washing machine and dryer according to the present invention, one portion of the cabinet being adjacent to the opening is tilted on a vertical plane. A front surface of the cabinet, on which the opening is provided, is tilted on the vertical plane. Also, the tub and the drum are tilted on the horizontal plane.

Also, the opening is a circle-shape, and the door is provided in a shape corresponding to the shape of the opening. The door includes a door frame of a ring shape; and a door glass being provided at the center of the door frame, through which a user can watch the inside of the drum.

The door frame has a cross section of a channel shape, and a groove is formed inside of the cross section. The edge of the door glass is outwardly bent so as to form an extension inserted to the groove of the door frame. The door glass has a recess at the center thereof toward the inside of the washing machine. The recess of the door glass has a tilted surface for preventing interference with the drum.

Accordingly, a user can watch the inside of the drum of the washing machine or the dryer. Also, a user can easily put the laundry into the inside of the washing machine or the dryer, and draw out the same.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUR THE INVENTION

Reference will now be made in detail to the preferred embodiments of the present invention, examples of which are illustrated in the accompanying drawings.

Figure 1:
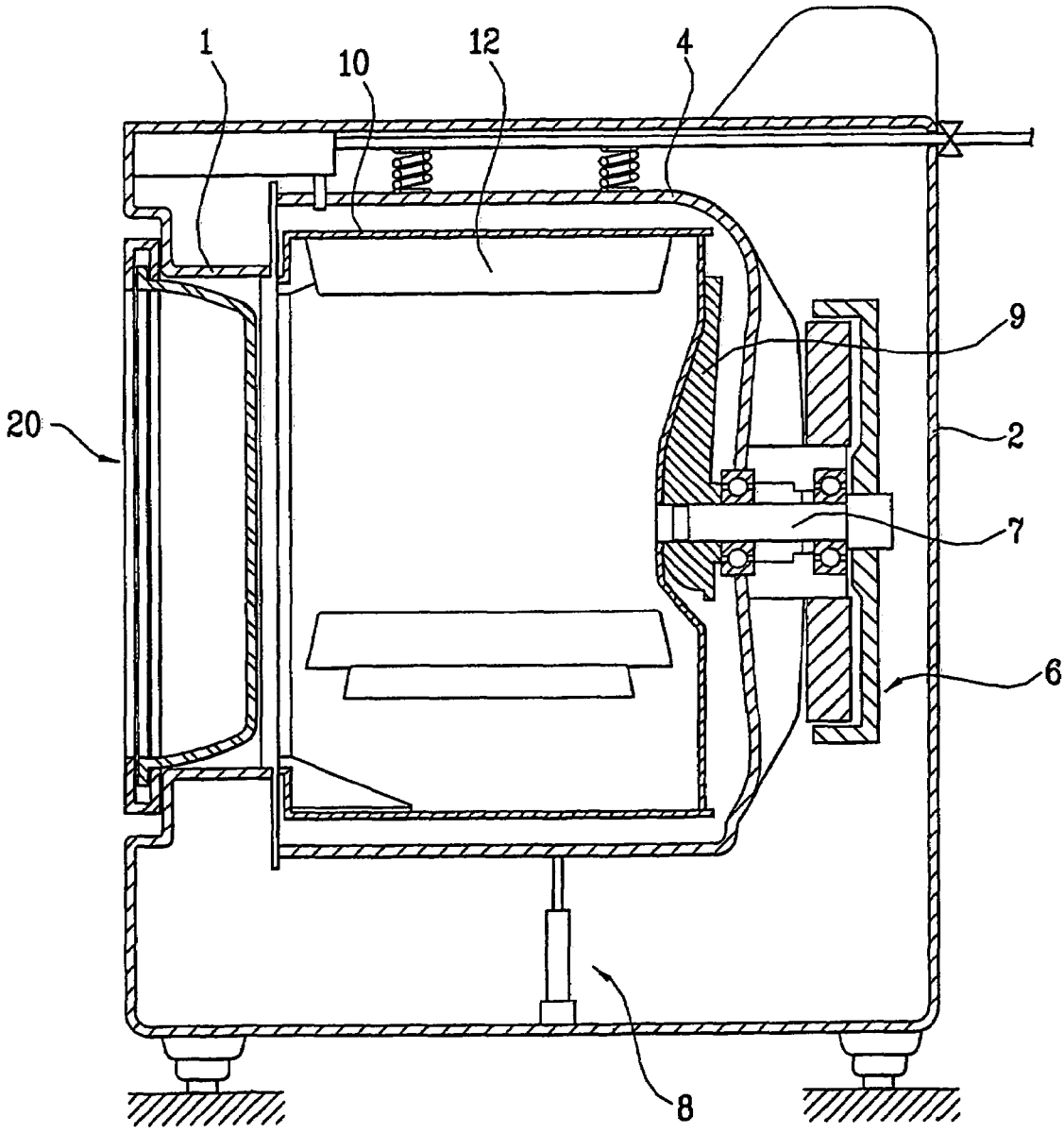
FIG. 1 is a cross sectional view illustrating main parts of a related art drum-type washing machine.
Figure 2:
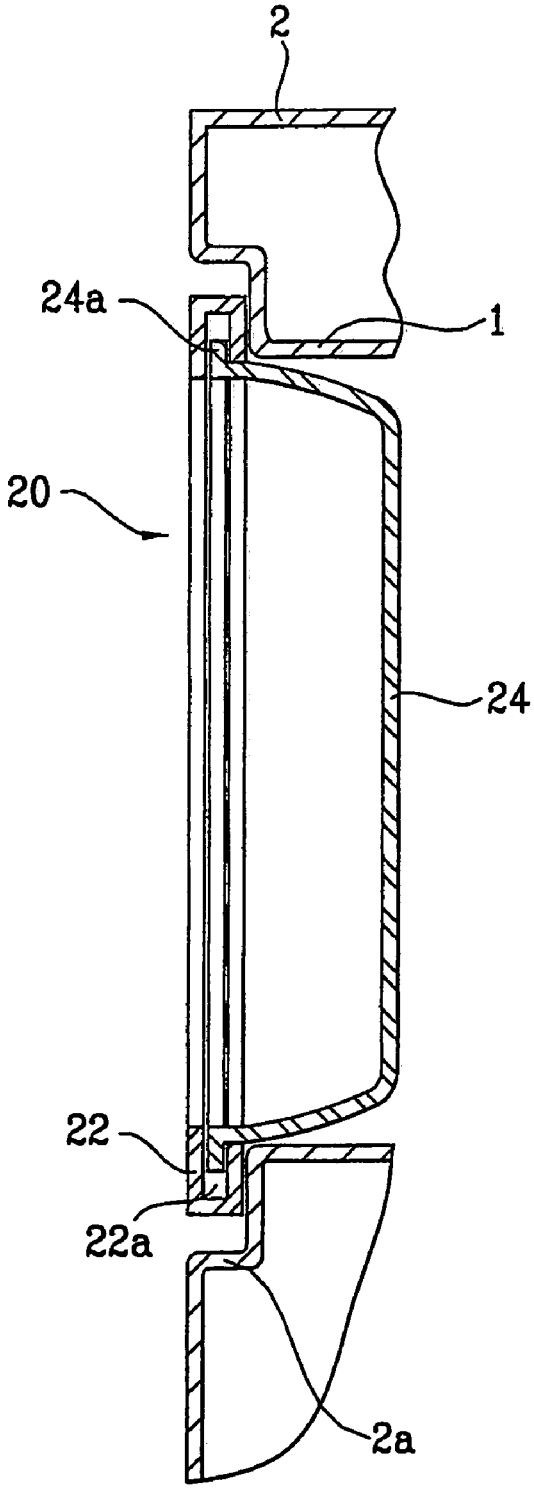
FIG. 2 is a cross sectional view illustrating a door structure of a related art washing machine and dryer.
Figure 3:
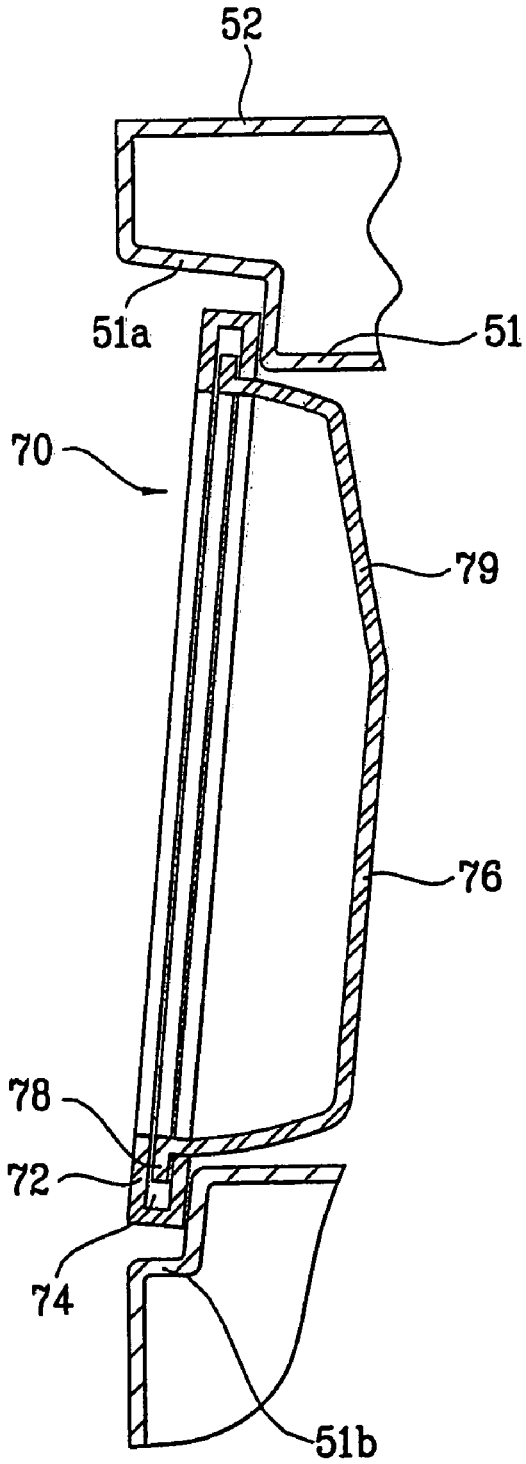
FIG. 3 is a cross sectional view illustrating a door structure of a washing machine and a dryer according to the present invention.

FIG. 3 is a cross sectional view illustrating a door structure of a washing machine and a dryer according to the present invention. Referring to FIG. 3, an upper portion of the door 70 is inwardly tilted on an opening 51. For this, one portion of the cabinet 52 being adjacent to the opening 51, on which the door 70 is placed, is tilted on a vertical plane. That is, the opening 51, on which the door 70 is provided, is tilted such that an upper portion 51*a* of the opening 51 is recessed to the inside of the cabinet 52 more than a lower portion 51*b* of the opening 51. Accordingly, the door 70 is provided to the opening 51 for being tilted on the vertical plane.

FIG. 3 illustrates the door structure, in which one portion of the cabinet 52 being adjacent to the opening 51 is recessed to the inside of the cabinet 52, so that the opening 52 is tilted. At this time, front lower and upper portions of the cabinet 52 are protruded except portions of the cabinet being adjacent to the opening 51.

In another structure of the door, a front surface of the cabinet 52 on which the opening 52 is provided may be tilted on the vertical plane. That is, the protruding portions, the front lower and upper portions of the cabinet 52 shown in FIG. 3, are removed, so that the door 70 and the cabinet 52 wholly form a tilted surface. In this state, it is preferable to form the opening 52 as a circle shape, and to form the door 70 for being corresponding to the shape of the opening 51.

Generally, the drum has a cross section of a circle shape, so that it is preferable to form a cross section of the opening 51 as a circle shape for being corresponding to that of the drum so as to easily put and draw out laundry. The door 70 is provided with a door frame 72 and a door glass 76. At this time, the door frame 72 is a ring-shape having a hole at the center thereof for watching the inside of the drum, and the door glass 76 being provided at the center of the door frame 72, through which a user can watch the inside of the drum 60. A connecting element (not shown) is further provided for opening and closing the door 70. The connecting element is provided between the door frame 72 and the opening 51 of the cabinet 52 for rotatably connecting the door frame 72 to one portion of the opening 51, thereby selectively opening or closing the door 70.

The structure of the door 70 will be explained in detail. The door frame 72 has a cross section of a channel shape, and a groove 74 is provided inside of the cross section. As shown in FIG. 3, the door frame 72 has a cross section of a ring-shape, the channel shape, and the groove 74 is provided at the cross section in a radial direction. The edge of the door glass 76 is outwardly bent for forming an extension 78 inserted to the groove 74 of the door frame 72. That is, the door glass 76 is a circle-shape, and the extension 78 at the edge of the door glass 76 is inserted to the groove 74 of the door frame 72. In this state, a waterproofing process is performed to a contact portion of the door frame 72 and the door glass 76. An assembly of the door 70 is completed.

Referring to FIG. 3, the door glass 76 has a recess at the center thereof, which is recessed to the inside of the washing machine. Preferably, in the recess of the door glass 76, a tilted surface is provided for being bent as a truncated shape, thereby preventing interference with the drum 60. As shown in the drawing, the door glass 76 has the recess toward the inside of the washing machine or the dryer. An upper portion of the door glass 76 is recessed to the inside of the opening 51 less than a lower portion of the door glass 76. The tilted surface 79, bending the upper portion of the door glass 76 as the truncated shape, is provided, thereby preventing interference with the drum 60 inside the opening 51.

Figure 4:
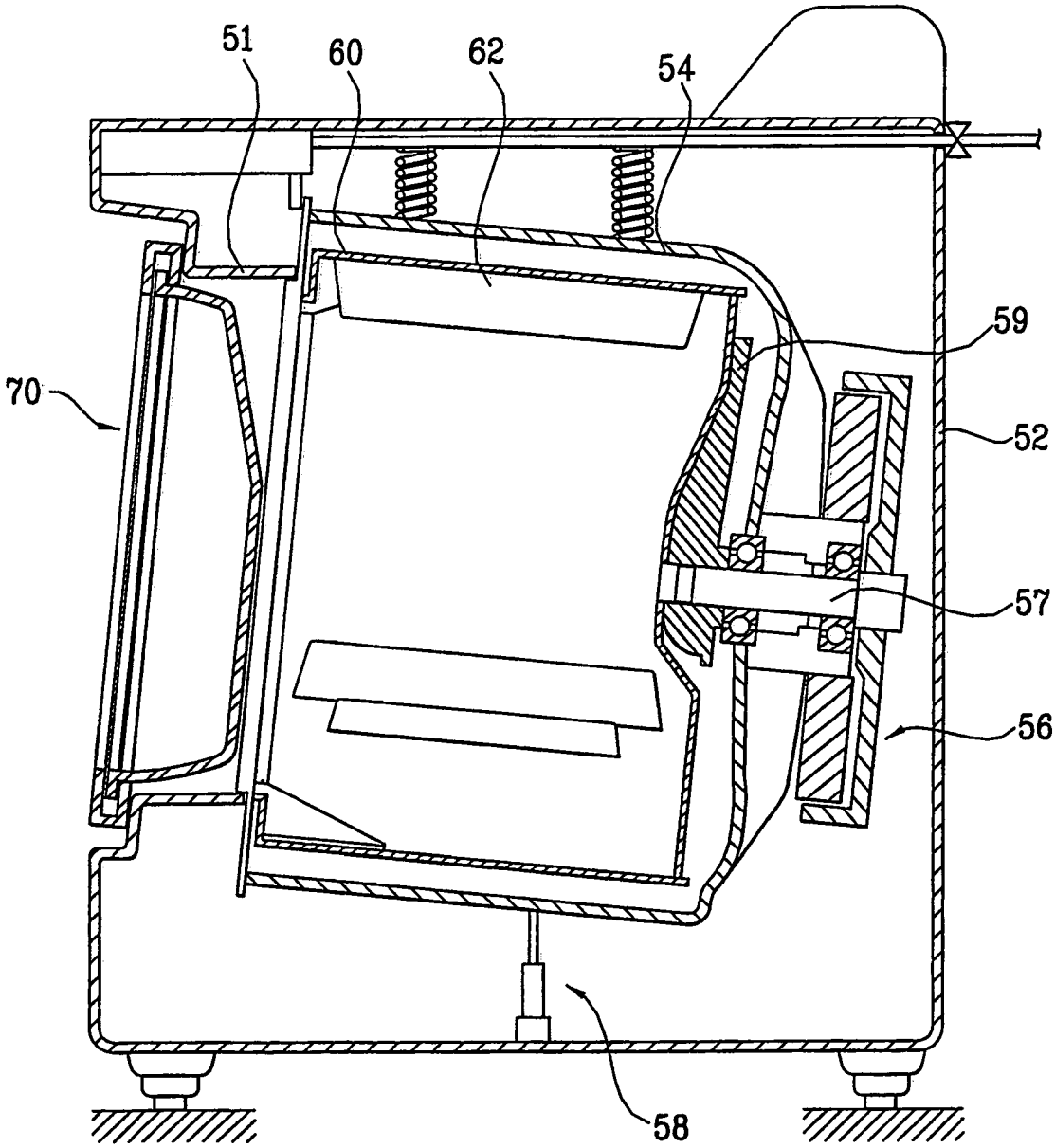
FIG. 4 is a cross sectional view illustrating main parts of a drum-type washing machine according to the present invention.

A washing machine, to which the aforementioned door structure is applied, according to one embodiment of the present invention will be explained with reference to the accompanying drawings. FIG. 4 is a cross sectional view illustrating main parts of a drum-type washing machine according to the present invention.

Referring to FIG. 4, the drum-type washing machine according to one embodiment of the present invention is provided with a cabinet 52, a tub 54, a drum 60, and a door 70. At this time, the cabinet 52 has an opening 51 at the front thereof, and the tub 54 is provided inside the cabinet 52 for storing washing water. The drum 60 is rotated in the center of a spinning shaft 57 by a motor 56 inside the tub 54. The door 70 is provided at the opening 5 1, and an upper portion of the door 51 is inwardly tilted.

A suspension 58 is provided between an outer wall of the tub 54 and an inner wall of the cabinet 52 for elastically supporting the tub 54 inside the cabinet 52. The motor 56 is connected to the spinning shaft 57 of the drum 60, which is provided at a rear outer wall of the tub 54 by penetrating the rear of the tub 54.

The motor 56 may be directly connected to the spinning shaft 57 as shown in the drawings. Also, the motor may be provided at a lower portion of the cabinet 52, and the motor may be connected to the spinning shaft 57 by a belt.

Preferably, the opening 51 is a circle-shape corresponding to a cross sectional shape of the drum 60 for easily putting and drawing the laundry, and the door 70 is a circle-shape corresponding to the cross sectional shape of the opening 51 for opening and closing the opening 51.

As shown in FIG. 4, the tub 54 and the drum 60 are tilted on a horizontal plane. That is, the tub 54 and the drum 60 have tilted angles to the horizontal plane. Thus, the spinning shaft of the drum 60 has a tilted angle corresponding to those of the tub 54 and the drum 60.

In case of that the door 70 has a tilted structure, it is preferable to provide the tub 54 and the drum 60 at the tilted angle to the horizontal plane, so that the user can easily put the laundry into the inside of the drum 60 and draw out the same, and the user can watch the inside of the drum during washing process steps. Preferably, the opening 51 of the drum 60 is parallel with the door glass 76 for preventing interference with the door glass 76. For this, in case of that the door 70 is tilted, the drum 60 has to be tilted.

However, in the present invention, it is not limited to the tub 54 and the drum 60 tilted on the horizontal plane. In case of that the tub 54 and the drum 60 are horizontally provided, the door 70 may be provided at the tilted angle.

As shown in FIG. 3, the door 70 comprises a door frame 72 and a door glass 76. The upper portion of the door glass 76 is recessed to the inside of the opening 51 more than the lower portion of the door glass 76 due to the tilted structure, so that a tilted surface 79 bent as a truncated shape is formed at the upper portion of the door glass 76, thereby preventing interference between the upper portion of the door glass and apparatuses inside the opening 51. In FIG. 4, it may not require the tilted surface 79 of the fillet shape since the drum 60 and the tub 54 are in parallel with the door, 70. However, in case of that the tilted angle of the door 70 is greater than those of the drum 60 and the tub 54, or in case of that the drum 60 and the tub 54 are horizontally provided, and the door 70 is provided at the tilted angle, the upper portion of the door glass 76 is recessed to the inside of the drum 60 more than the lower portion of the door glass 76, thereby generating interference with apparatuses inside the drum 60. Thus, the tilted surface 79 bent as the truncated shape is provided at the upper portion of the door glass 76 for preventing the interference between the upper portion of the door glass and the apparatuses inside the drum 60.

Figure 5:
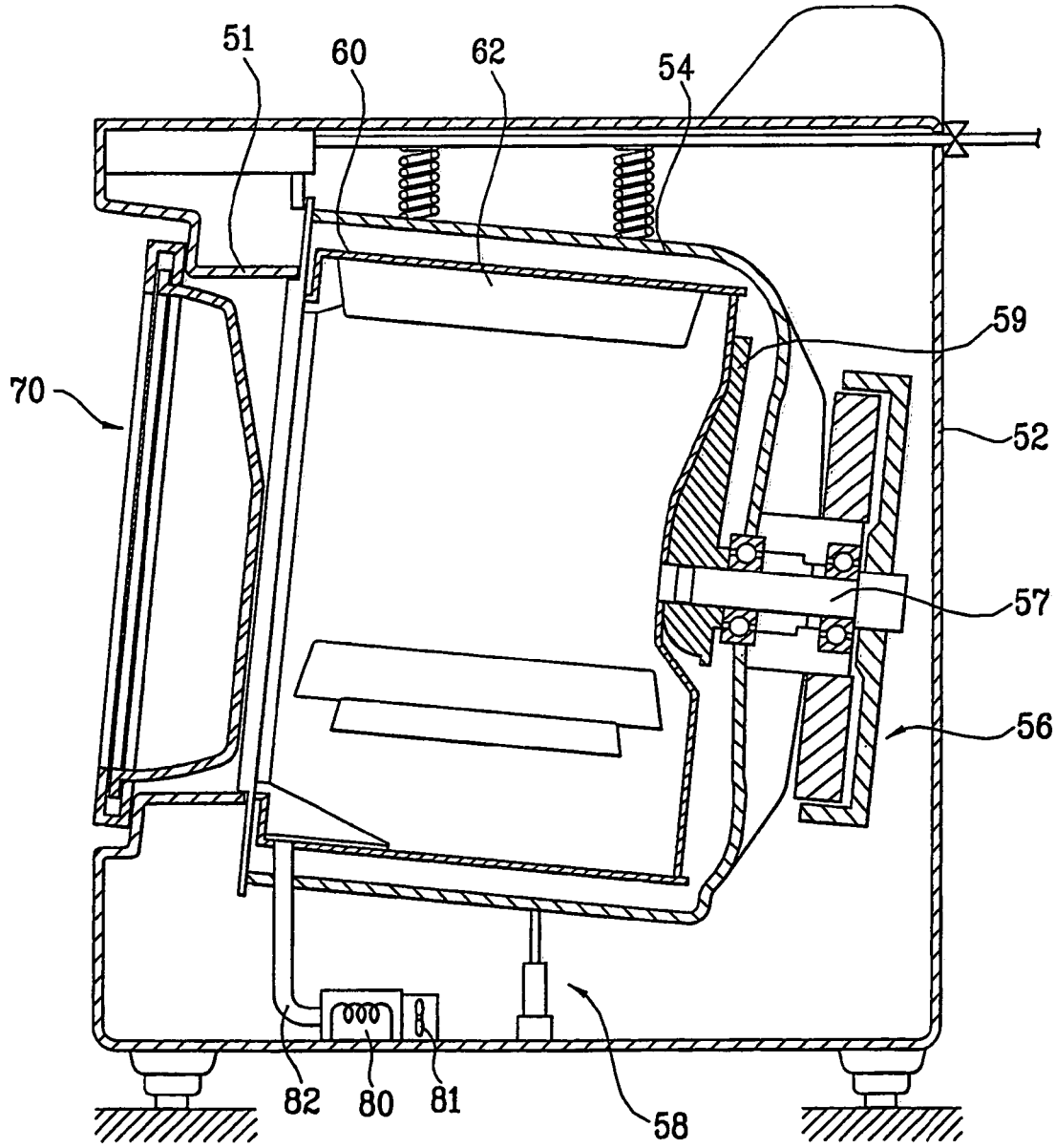
FIG. 5 is a cross sectional view illustrating main parts of a dryer according to the present invention.

A dryer, to which the aforementioned door structure is applied, according to the present invention will be explained with reference to the accompanying drawings. FIG. 5 is a cross sectional view illustrating main parts of a drum-type dryer according to the present invention.

Referring to FIG. 5, the drum-type dryer according to the preset invention is provided with a cabinet 52, a drum 60, a heater 80, a blower, and a door 70. At this time, the cabinet 52 has an opening 51 at the front thereof, and the drum 60 is rotatably provided to a spinning shaft 57 by a motor 56 inside the cabinet 52. The heater 80 generates hot air for drying the laundry inside the cabinet 52, and the blower blows out the hot air generated from the heater 80. The door is provided at the opening 51 for being tilted to the inside of the dryer.

Like the aforementioned washing machine, in case of that the door 70 of the dryer is a tilted structure, it is preferable to provide the drum 60 tilted on the vertical plane, so that the user can easily put the laundry into the inside of the drum 60, and the user can watch the inside of the drum 60 during drying process steps. In the dryer, the tub 54 may be provided in the same way as the washing machine, thereby performing washing and drying process steps at the same time.

At this time, the blower is provided with a blowing fan 81 and a blowing duct 82. The blowing fan 81 circulates the hot air inside of the drum 60, and the blowing duct 82 serves as a flow passage of the circulated hot air.

The drying process steps will be explained in detail. The hot air being introduced from the blowing duct 82 vaporizes moist of the wet laundry, and the vaporized moist is exhausted to the outside of the dryer through an exhausting hole (not shown) according to a convection, thereby rapidly drying the laundry.

Generally, the dryer is classified into an exhausting type and a condensing type. In the exhausting type dryer, the hot air used for drying the laundry is directly exhausted to the outside of the dryer. In the condensing type dryer, the hot air being blown from the drum 60 is condensed for removing the moist thereof, and then the hot air removing the moist is re-circulated, and is flown into the inside of the drum 60.

The exhausting type dryer further includes an exhausting duct (not shown), and the condensing type dryer further includes a circulation fan (not shown) and a condensing element (not shown).

A suspension 58 is provided between an outer wall of the tub 54 and an inner wall of the cabinet 52 for elastically supporting the tub 54 inside the cabinet 52. A motor 56 is connected to a spinning shaft 57 of the drum 60, which is provided at a rear outer wall of the tub 54 by penetrating the rear of the tub 54.

The drum 60 of the dryer is rotated at a low speed as compared with the washing machine. In the dryer, the motor 56 may be directly connected to the spinning shaft 57 as shown in the drawings. However, the motor 56 may be provided at a lower portion of the cabinet 52, and the motor 56 may be connected to the spinning shaft by a belt.

As shown in FIG. 4, the tub 54 and the drum 60 are tilted on a horizontal plane at a predetermined angle, so that the spinning shaft of the drum, 60 is tilted on the horizontal plane at the predetermined angle. Accordingly, in the door structure, it is preferable to provide the door 70 at the tilted angle corresponding that of the drum 60. That is, the door 70 is provided at the tilted angle to the vertical plane for easily putting the laundry into the inside of the drum 60 and drawing out the same, and for watching the inside of the drum 60. However, in the present invention, it is not limited to the tub 54 and the drum 60 tilted on the vertical plane. Even though the tub 54 and the drum 60 are horizontally provided, the door 70 may be tilted.

As mentioned above, one portion of the opening 51, on which the door 70 is provided, has to be tilted for providing the door 70 being tilted on the vertical plane. As shown in FIG. 3, an upper portion 51*a* of the opening 51 is recessed to the inside of the opening 51 more than a lower portion 51*b* of the opening 51, thereby providing the opening 51 being tilted. Thus, the door 70 including a door frame 72 and a door glass 76 is tilted to the opening 51, and one end of the door frame 72 is rotatably connected to one end of the opening 51 for selectively opening and closing the door 70.

In the dryer, an upper portion of the door glass 76 is recessed to the inside of the opening 51 more than a lower portion of the door glass 76, so that the upper portion of the door glass 76 has a tilted surface 79 being bent as a truncated shape, thereby preventing interference between the upper portion of the door glass and apparatuses inside the opening 51.

The operation of the drum-type washing machine and the dryer according to the present invention will be explained as follows.

First, a power is applied after putting the laundry and detergent into the inside of the drum 60 of the drum-type washing machine, so that the motor 56 is driven. Thus, the spinning shaft 57 and the drum 60 are driven, thereby generating water current.

After completing washing process steps, the laundry is put into the inside of the dryer. On applying a power, the hot air generated from the heater 80 is flown into the inside of the drum 60 by the blowing fan 81, thereby drying the laundry. That is, the moist of the laundry vaporizes by the hot air, the vaporized moist is condensed to water, and the condensed water is drained to the outside of the dryer, thereby smoothly performing the drying process steps. At this time, the washing machine and the dryer may be formed in one body, or the washing machine and the dryer are respectively provided.

Herein, the drum 60 and the door 70 are tilted, so that the user can put the laundry into the inside of the drum 60 without bending over. Also, the user can watch the inside of the drum 60 during drying process steps.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

The drum-type washing machine and the dryer according to the present invention have the following advantages.

The door of the present invention is provided tiltedly to the opening of the cabinet, so that the user can put the laundry into the inside of the drum and draw out the same without bending over, and the user can watch the inside of the drum during washing or drying process steps, thereby improving user's convenience.

What is claimed is:

1. A washing machine comprising:

a cabinet having an opening at the front thereof;

a tub provided inside the cabinet for storing washing water;

a drum being rotatably provided to a spinning shaft by a motor inside the tub; and a door provided at the opening, wherein the door is vertically tilted such that an upper portion of the door is recessed relative to the front of the cabinet and wherein a lower portion of the door is substantially flush with the front of the cabinet; and the door comprises door glass, the door glass having an upper recessed portion and a lower recessed portion which extends towards the inside of the washing machine, the upper portion extending less towards the inside of the washing machine than the lower portion.

2. The washing machine as claimed in claim 1, wherein one portion of the cabinet being adjacent to the opening is tilted on a vertical plane.

3. The washing machine as claimed in claim 1, wherein a front surface of the cabinet, on which the opening is provided, is tilted on the vertical plane.

4. The washing machine as claimed in claim 1, wherein the tub and the drum are tilted on the horizontal plane.

5. The washing machine as claimed in claim 1, wherein the opening is a circle-shape, and the door is provided in a shape corresponding to the shape of the opening.

6. The washing machine as claimed in claim 1, wherein the door comprises: a door frame of a ring shape; and the door glass being provided at the center of the door frame, through which a user can watch the inside of the drum.

7. The washing machine as claimed in claim 6, wherein the door frame has a cross section of a channel shape, and a groove is formed inside of the cross section.

8. The washing machine as claimed in claim 7, wherein the edge of the door glass is outwardly bent so as to form an extension inserted to the groove of the door frame.

9. The washing machine as claimed in claim 6, wherein the door glass has a recess at the center thereof toward the inside of the washing machine.

10. The washing machine as claimed in claim 9, wherein the recess of the door glass has a tilted surface for preventing interference with the drum.

11. A dryer comprising:

a cabinet having an opening at the front thereof;

a drum being provided inside the cabinet for being rotatably provided to a spinning shaft by a motor;

a heater generating a hot air drying the laundry inside the cabinet;

a blowing element blowing the hot air generated from the heater to the inside of the drum; and a door being provided at the opening, wherein the door is tilted towards the inside of the dryer, and wherein the door comprises door glass, the door glass having an upper recessed portion and a lower recessed portion which extends towards the inside of the dryer, the upper portion extending less towards the inside of the dryer than the lower portion.

12. The dryer as claimed in claim 11, wherein one portion of the cabinet being adjacent to the opening is tilted on a vertical plane.

13. The dryer as claimed in claim 11, wherein a front surface of the cabinet, on which the opening is provided, is tilted on the vertical plane.

14. The dryer as claimed in claim 11, wherein the drum is tilted on the horizontal plane.

15. The dryer as claimed in claim 11, wherein the opening is a circle-shape, and the door is provided in a shape corresponding to the shape of the opening.

16. The dryer as claimed in claim 11, wherein the door comprising: a door frame of a ring shape; and the door glass being provided at the center of the door frame, through which a user can watch the inside of the drum.

17. The dryer as claimed in claim 16, wherein the door frame has a cross section of a channel shape, and a groove is formed inside of the cross section.

18. The dryer as claimed in claim 17, wherein the edge of the door glass is outwardly bent so as to form an extension inserted to the groove of the door frame.

19. The dryer as claimed in claim 16, wherein the door glass has a recess at the center thereof toward the inside of the washing machine.

20. The dryer as claimed in claim 19, wherein the recess of the door glass has a tilted surface for preventing interference with the drum.

* * * * *